US011401735B2

(12) United States Patent
Schonberger

(10) Patent No.: US 11,401,735 B2
(45) Date of Patent: Aug. 2, 2022

(54) SLIDING DOOR LATCH SYSTEMS AND METHOD

(71) Applicant: Jack Schonberger, Toms River, NJ (US)

(72) Inventor: Jack Schonberger, Toms River, NJ (US)

( * ) Notice: Subject to any disclaimer, the term of this patent is extended or adjusted under 35 U.S.C. 154(b) by 278 days.

(21) Appl. No.: 16/856,904

(22) Filed: Apr. 23, 2020

(65) Prior Publication Data

US 2020/0378159 A1 Dec. 3, 2020

Related U.S. Application Data

(60) Provisional application No. 62/854,312, filed on May 29, 2019.

(51) Int. Cl.

| | |
|---|---|
| ***E05B 65/08*** | (2006.01) |
| ***E05B 65/00*** | (2006.01) |
| ***E05C 3/30*** | (2006.01) |
| ***E05B 15/02*** | (2006.01) |
| ***E05B 63/18*** | (2006.01) |

(Continued)

(52) U.S. Cl.

CPC ..... *E05B 65/0811* (2013.01); *E05B 15/0205* (2013.01); *E05B 63/18* (2013.01); *E05B 65/0014* (2013.01); *E05C 3/30* (2013.01); *E05B 63/185* (2013.01); *E05B 65/08* (2013.01); *E05B 2015/023* (2013.01); *E05C 3/12* (2013.01); *E05C 3/145* (2013.01); *E05Y 2900/132* (2013.01); *Y10S 292/46* (2013.01); *Y10T 292/0826* (2015.04); *Y10T 292/0844* (2015.04); *Y10T 292/0911* (2015.04); *Y10T 292/1041* (2015.04); *Y10T 292/1047* (2015.04); *Y10T 292/57* (2015.04)

(58) Field of Classification Search

CPC ..... E05B 15/0205; E05B 65/0014; E05B 2015/023; E05B 65/0811; E05B 65/08; E05B 63/185; E05B 15/0295; E05B 63/18; E05C 3/30; E05C 3/12; E05C 3/145; E05Y 2900/132; Y10S 292/46; Y10T 292/0806; Y10T 292/0844; Y10T 292/1041; Y10T 292/57; Y10T 292/1047; Y10T 292/0826

USPC ..... 70/97, 105

See application file for complete search history.

(56) References Cited

U.S. PATENT DOCUMENTS 2,701,156 A * 2/1955 Palmer, Jr. ..... E05B 65/0817 70/95

2,710,217 A * 6/1955 Curtiss, Jr. ..... E05B 15/0245 292/341.18

(Continued)

*Primary Examiner* — Christine M Mills

*Assistant Examiner* — Faria F Ahmad

(74) *Attorney, Agent, or Firm* — Runyan Law; Charles Runyan

(57) ABSTRACT

A sliding door latch system and method is disclosed herein. The sliding door latch system is used to prevent movement of a sliding door between a closed position and an open position relative to a fixed door frame. The device may be installed as a secondary safety latch on a sliding door having a primary latch that is located at an elevation within the reach of the child. The device may be installed at an elevation above the reach of the child, but readily within the reach of an adult user. The sliding door latch includes a latch arm located outside the sliding door to simplify installation. The latch arm is user-locatable in a latched position, a momentarily released position, and a held-in-release position.

14 Claims, 6 Drawing Sheets

(51) Int. Cl.
*E05C 3/12* (2006.01)
*E05C 3/14* (2006.01)

(56) References Cited

U.S. PATENT DOCUMENTS 2,789,852 A * 4/1957 Eads ..... E05B 65/0817 292/110
2,928,689 A * 3/1960 Mineah ..... E05B 65/0817 292/113
2,980,458 A * 4/1961 Russell ..... E05B 65/0817 292/113
3,019,043 A * 1/1962 Woodworth ..... E05B 65/0817 292/113
3,025,693 A * 3/1962 Braginetz ..... E05B 65/0811 70/99
3,105,711 A * 10/1963 Woodworth ..... E05B 65/0817 292/113
3,117,811 A * 1/1964 Duvall ..... E05B 65/0817 292/113
3,596,954 A 8/1971 Hull et al.
3,877,739 A * 4/1975 Cowen ..... E05B 65/0811 292/DIG. 55
3,904,229 A * 9/1975 Waldo ..... E05B 65/087 292/108
4,024,739 A * 5/1977 Kaufman ..... E05B 65/087 292/108
4,068,874 A * 1/1978 Fleming ..... E05B 65/0811 70/96
4,127,016 A * 11/1978 Ibsen ..... E05B 63/0013 70/92
4,237,711 A * 12/1980 Kambic ..... E05B 47/0002 70/432
4,378,684 A * 4/1983 Dugan ..... E05B 65/0811 70/137
4,429,556 A * 2/1984 Kambic ..... E05B 57/00 70/472
4,563,885 A * 1/1986 Madden ..... E05B 65/0811 70/210
4,639,021 A 1/1987 Hope
4,776,619 A * 10/1988 Daugherty ..... E05B 65/0811 292/201
4,881,766 A * 11/1989 Schmidt ..... E05B 17/2026 292/201
4,973,091 A 11/1990 Paulson
5,069,492 A 12/1991 Tatham
5,098,139 A * 3/1992 Larsson ..... E05B 65/0811 292/97
5,221,115 A * 6/1993 Takimoto ..... E05B 65/0811 292/216
5,393,110 A * 2/1995 Nakamori ..... E05C 19/024 292/216
5,582,442 A * 12/1996 Nolte ..... E05B 65/0811 292/357
5,595,409 A * 1/1997 Fier ..... E05B 65/0817 292/341.13
5,653,483 A * 8/1997 Grover ..... E05B 65/0811 70/DIG. 52
5,676,408 A * 10/1997 Davidian ..... E05B 65/0811 292/197
5,722,704 A * 3/1998 Chaput ..... E05C 9/047 292/26
5,816,629 A * 10/1998 Donald ..... E05B 15/102 292/191
6,068,308 A 5/2000 Molzer
6,327,879 B1 * 12/2001 Malsom ..... E05B 65/0811 292/210
6,502,435 B2 * 1/2003 Watts ..... E05B 65/0858 70/91
6,546,765 B1 * 4/2003 Linares ..... E05B 13/108 70/216
6,648,379 B1 * 11/2003 Kordowski ..... E05B 81/14 292/216
6,688,656 B1 * 2/2004 Becken ..... E05B 65/0858 292/41
6,945,572 B1 * 9/2005 Hauber ..... E05B 65/0811 70/95
7,178,839 B2 * 2/2007 Tsai ..... E05B 65/0858 292/25
7,210,712 B2 * 5/2007 Artsiely ..... E05B 17/2007 292/109
7,255,375 B2 * 8/2007 Heid ..... E05B 65/0817 292/199
7,261,330 B1 * 8/2007 Hauber ..... E05B 65/0811 70/95
7,373,794 B1 * 5/2008 DePass ..... E05B 65/0811 292/195
7,866,712 B2 * 1/2011 Kintz ..... E05B 65/1033 292/121
8,491,022 B2 * 7/2013 Liebel ..... E05B 1/00 292/336.3
8,516,862 B2 * 8/2013 Stuckey ..... E05B 83/12 292/DIG. 31
8,870,245 B2 * 10/2014 Johnson ..... E05B 15/0205 292/341.14
8,931,812 B1 * 1/2015 Hauber ..... E05B 15/0053 292/37
8,960,733 B1 * 2/2015 Smith ..... E05C 7/02 292/226
8,973,416 B2 * 3/2015 Terei ..... E05B 63/0013 70/105
9,328,542 B2 * 5/2016 Gosling ..... F16H 25/14
9,410,350 B2 * 8/2016 Stendal ..... E05C 19/12
9,637,957 B2 * 5/2017 Hagemeyer ..... E05C 1/004
9,790,716 B2 * 10/2017 Hagemeyer ..... E05B 81/54
9,885,200 B2 * 2/2018 Hagemeyer ..... E05B 1/003
9,890,570 B2 * 2/2018 Horwood ..... E05B 15/0086
11,008,775 B2 * 5/2021 Chaffin ..... E05D 15/565
11,015,368 B2 * 5/2021 DeBoer ..... E05B 65/08
D934,653 S * 11/2021 Syed ..... D8/302
2003/0160463 A1 * 8/2003 Tonges ..... E05B 63/18 292/336.3
2003/0227176 A1 * 12/2003 Belloma ..... E05B 65/0811 292/96
2004/0050119 A1 * 3/2004 Toulis ..... E05B 65/0811 70/97
2004/0079123 A1 * 4/2004 Alchin ..... E05B 65/0811 70/100
2004/0145192 A1 * 7/2004 Huang ..... E05B 3/003 292/336.3
2004/0183316 A1 * 9/2004 Walls ..... E05B 63/04 292/336.3
2004/0195841 A1 * 10/2004 Liu ..... E05B 63/0013 292/24
2004/0212198 A1 * 10/2004 Glover ..... E05B 65/0811 292/336.3
2004/0217600 A1 11/2004 Argo
2004/0245784 A1 * 12/2004 Tsai ..... E05B 65/0858 292/51
2004/0262929 A1 * 12/2004 Trickel ..... E05B 65/0841 292/241
2005/0082842 A1 * 4/2005 Warmke ..... E05B 81/14 292/216
2005/0166648 A1 * 8/2005 Ruan ..... E05B 17/2084 70/370
2006/0103146 A1 * 5/2006 Noel ..... E05B 85/02 292/216
2006/0119108 A1 * 6/2006 Heid ..... E05B 15/0006 292/97
2007/0200370 A1 * 8/2007 Reithmeyer ..... E05B 65/087 292/340
2008/0211240 A1 * 9/2008 Mitchell ..... E05B 17/0033 292/220
2008/0256992 A1 * 10/2008 Chung ..... E05B 65/0811 70/77
2008/0258475 A1 * 10/2008 Chung ..... E05C 9/1875 292/25
2009/0044918 A1 * 2/2009 Goodman ..... E05B 65/0085 160/202

(56) References Cited

U.S. PATENT DOCUMENTS

2009/0115204 A1* 5/2009 Rycroft ..... E05B 63/20 70/276
2010/0229609 A1* 9/2010 Bergmann ..... E05B 65/0025 70/95
2010/0327612 A1* 12/2010 Liebel ..... E05B 7/00 292/336.3
2011/0023564 A1* 2/2011 Teskey ..... E05C 3/30 70/452
2011/0285149 A1* 11/2011 Uyeda ..... E05B 63/04 292/341.15
2012/0104771 A1* 5/2012 Johnson ..... E05B 63/0013 292/95
2012/0111069 A1* 5/2012 Padjen ..... E05C 5/04 70/91
2012/0291359 A1* 11/2012 Hans ..... E05B 5/003 49/404
2013/0020813 A1* 1/2013 Storr ..... E05B 63/244 292/150
2013/0106119 A1* 5/2013 Stendal ..... E05C 19/12 292/113
2013/0125389 A1* 5/2013 VanHellemont ..... E05C 1/06 292/145
2013/0270844 A1* 10/2013 Berger ..... E05B 1/003 292/336.3
2014/0265371 A1* 9/2014 Weinerman ..... E05B 85/16 292/336.3
2014/0290141 A1* 10/2014 Mayer ..... E05B 63/123 292/96
2014/0300116 A1* 10/2014 Hellwig ..... E05B 65/0811 292/336.3
2018/0038134 A1* 2/2018 Lin ..... E05B 65/0811
2018/0223571 A1* 8/2018 Jean ..... E05B 5/003
2020/0173197 A1* 6/2020 Jean ..... E05B 65/0811
2020/0173198 A1* 6/2020 Stenhouse ..... E05B 63/185
2022/0010593 A1* 1/2022 McDaniel ..... E05B 1/0015

* cited by examiner

SLIDING DOOR LATCH SYSTEMS AND METHOD

CROSS-REFERENCE TO RELATED APPLICATION

The present application is related to and claims priority to U.S. Provisional Patent Application No. 62/854,312 filed 29 May 2019, which is incorporated by reference herein in its entirety.

BACKGROUND OF THE INVENTION

The following includes information that may be useful in understanding the present disclosure. It is not an admission that any of this information is prior art nor material to the presently described or claimed inventions, nor that any publication or document that is explicitly or implicitly referenced is prior art.

TECHNICAL FIELD

The present invention generally relates to the field of doors and hardware and, more specifically, relates to door latches.

RELATED ART

Many individuals and families live in domestic residences in modern society. Many of these residences have swimming pools in the backyard for enjoyment during hot weather. Children especially enjoy using pools. But they may not understand the danger of using pools, and consequently many of these drown. Many of the drownings are preventable. If a child cannot leave the house on their own and get to the pool, drowning can be averted. Children have enough familiarity with currently available doorknobs that they can open them if they have developed enough dexterity. A suitable solution is desired.

Various attempts have been made to solve problems found in these doors and hardware art. Among these are found in U.S. Pat. No. 5,069,492 to Tatham relates to an automatic sliding door latch. The described automatic sliding door latch includes an automatic sliding door or window latching device which includes a hook attached to a door or window jamb immediately opposite the door or window frame where a mechanism containing a bendable plate having a hole in the center thereof is placed. When the door or window is pushed closed, the plate moves up over the hook until the opening is reached at which point the plate snaps firmly against the hook. The plate is attached to an axle and corresponding handles such that when one of the handles is turned, the plate moves away from the hook, unlatching the door or window. In order to avoid deforming the plate during use, the range of rotation of the handles may be limited according to the size of an opening into which a tab attached to a key slid over the axle is displaced.

SUMMARY OF THE INVENTION

Because of the foregoing disadvantages inherent in the known door and hardware art, the present disclosure provides a novel, sliding-door latch system and method sliding door latch system and method. The general purpose of the present disclosure, which will be described subsequently in greater detail, is to provide a sliding door latch system and method.

A sliding door latch system and method are disclosed. This disclosure provides a sliding door latch system for selectively preventing sliding movement of a sliding door between a closed position and an open position relative to a fixed door frame, the sliding door latch system comprising: a safety-latch housing mountable to the sliding door; a latch arm located outside the sliding door, the latch arm including a proximal end pivotally mounted to an interior portion of the safety-latch housing and configured to rotate about a pivot axis, an intermediate portion extending from the proximal end outwardly of the safety-latch housing, and a distal end including a latch hook configured to rotate with the latch arm about the first axis between a latched position, a momentarily-released first position, and a held-in-release second position; a first actuator knob operationally coupled with the latch arm, the first actuator knob configured to enable rotation (in some embodiments user-actuated rotation) of the latch hook about the pivot axis between the latched position, the momentarily-released first position, and the held-in-release second position, a momentarily-released first position, and a held-in-release second position; a rotational biaser operably coupled to the latch arm and configured to rotationally bias the latch hook toward the latched position; a latch-arm retainer configured to releasably-retain the latch arm in the held-in-release second position; a latch-arm release configured to enable release of the latch arm from the held-in-release second position to the latched position; and a fixed catch member, the fixed catch member including a latch-hook receiver configured to receive the latch hook in the latched position, the latch-hook receiver preventing a translational movement of the latch arm and the sliding movement of the sliding door between the closed position and the open position when the latch hook is in such latched position, and a frame mount configured to assist mounting of the latch-hook receiver to the fixed door frame.

In accordance with another preferred embodiment hereof, this disclosure provides a method of using a sliding door latch system to selectively prevent sliding movement of a sliding door having a primary latch, between a closed position and an open position relative to a fixed door frame, the method comprising the steps of: providing sliding door latch system comprising a latch arm located outside the sliding door and user-locatable in a latched position, a momentarily released first position, and a held-in-release second position; a first actuator knob and a second actuator knob operationally coupled with the latch arm and configured to enable rotation of the latch hook between the latched position, the momentarily-released first position, and the held-in-release second position; a spindle shaft configured to rotationally couple the first actuator knob, the latch arm, and the second actuator knob; and a fixed catch member mountable to the fixed door frame, the fixed catch member configured to receive the latch arm in the latched position; selecting a mounting position for mounting the sliding door latch system to the sliding door; modifying the sliding door to provide a passage through which the spindle shaft may pass; mounting the sliding door latch system to the sliding door; and mounting the fixed catch member to the fixed door frame; whereby the sliding movement of the sliding door between the closed position and the open position relative to the fixed door frame is selectively prevented. Even further, it provides such a method, further comprising the steps of selecting a mounting position for mounting the sliding door latch system to the sliding door having an elevation above the primary latch.

For purposes of summarizing the invention, certain aspects, advantages, and novel features of the invention have been described herein. It is to be understood that not necessarily all such advantages may be achieved following any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood by referencing the following drawings and detailed description.

BRIEF DESCRIPTION OF THE DRAWINGS

The figures which accompany the written portion of this specification illustrate embodiments and methods of use for the present disclosure, a sliding door latch system, and method, constructed and operative according to the teachings of the present disclosure.

The various embodiments of the present invention will be described in conjunction with the appended drawings, wherein like designations denote like elements.

DETAILED DESCRIPTION

Figure 1:
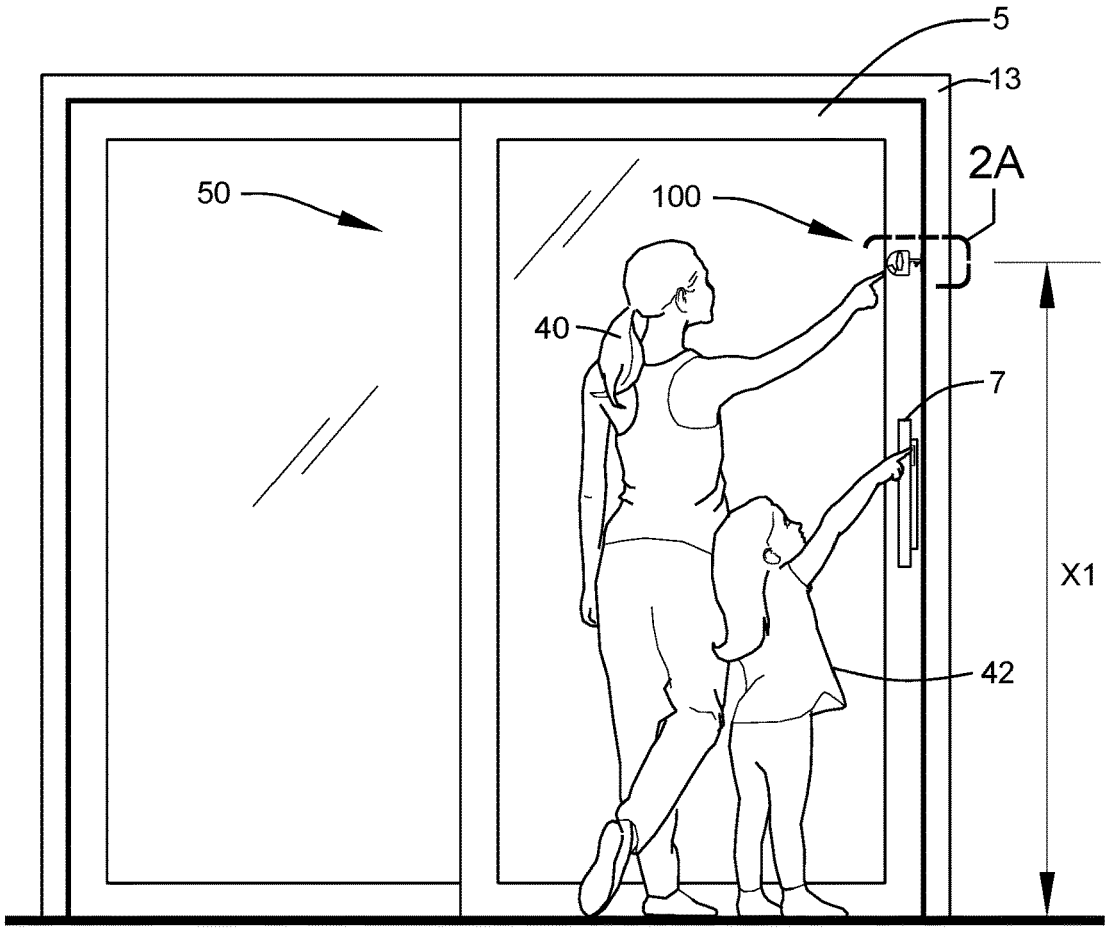
FIG. 1 is a diagrammatic view of the sliding door latch during an 'in-use' condition, according to an embodiment of the disclosure.

As discussed above, embodiments of the present disclosure relate to improved door and hardware and, more particularly, to a sliding door latch system and method as used to improve the operational convenience and safety of sliding doors.

Generally, the present disclosure provides a safety means for limiting ingress and egress of pool areas or those where access should be authorized for the safety of occupants. The present invention is superior to other systems in that it effectively provides secure door latching means.

The disclosed sliding door latch is meant to protect little children that may not be able to open the sliding door and go out of the house on their own. This device may be an important safety feature, especially if there is a pool in the back of the house, or simply to prevent a child from wandering out on their own. The latch may be installed on the upper section of the sliding door at an elevation that the child cannot reach. The latch may have a handle inside and outside the house, and an adult would simply push down on the latch and slide the door open. In some embodiments, the latch automatically closes when the door shuts (like a doorknob of a hinged door).

Many children drown in private pools on an annual basis. Many of the drownings are preventable. If the child cannot leave the house o and get to the pool unsupervised, drowning can be averted.

Unlike the doorknob of a hinged door, the disclosed device uses a hook latch rather than a tongue.

The device may be constructed from stainless steel, aluminum, plastic, or combinations of these materials. These materials should be selected to provide a durable device.

In some embodiments, the disclosed latch is easy to install. The device has the latch arm of the device located outside of the door, and not in the usual centered-in-door location that the latch arm (i.e., tongue) of a conventional doorknob, in some embodiments, to make installation easier.

When the sliding door is closed, the latch hooks on to a bar to secure the door. When the user would like to open the door simply pushing down or otherwise rotating the knob lifts the hook up over the bar allowing the door to slide open. When the door closes again, the hook latch is over the bar, and the door cannot open up.

Moreover, the sliding door latch may be useful for preventing little children from opening a door. The device may be a latch that is attached to a sliding door. The latch may be integrated into the door, or be installed on the exterior of a door. The latch may be installed on the upper section of a sliding door, out of reach of children. The latch may include a handle on the inside and outside of the house. The disclosed sliding door latch may look similar to a doorknob. But the latching mechanism uses novel component arrangements to latch and unlatch the door. Despite these distinct mechanical differences, the operation of the latch remains intuitive and straightforward: The user simply rotates the knob to disengage the latch allowing for the door to open.

The sliding door latch may protect children little enough not to be allowed to open and exit through the sliding door on their own. Restricting a child's access to a backyard pool is an important safety measure, as is preventing a child from exiting through a sliding door on their own.

The latch may have a thumb-turn on the door's interior and the exterior (similar to a doorknob on a swinging door). When the adult would like to go in, they may just simply rotate the latch and slide open the door. The latch may be configured to close automatically when the door shuts (again, similar to a doorknob on a hinged door). The latch, when turned counter-clockwise (in preferred embodiments), may disengage the latch to allow the door to be opened as a latch hook of the device is disengaged from a fixed bar mounted to the door frame. When turned, the latch re-engages with the bar. The handle may be manipulated from either side of the door with relative ease (provided the operator is of sufficient height to reach it).

The device may be manufactured from stainless steel, or aluminum, or durable plastic. Other materials may also be used. The exact specifications, materials used, and method of use of the sliding door latch system may vary upon manufacturing.

Referring now more specifically to the drawings by numerals of reference, there is shown in FIGS. 1-9, various views of a sliding door latch 100 of a sliding door latch system.

FIG. 1 shows a sliding door latch 100 during an 'in-use' condition 50, according to an embodiment of the present disclosure. Here, the sliding door latch 100 may be beneficial for selectively preventing the opening of a sliding door 5. More specifically, the sliding door latch 100 may be used to prevent a child 42 from opening the sliding door 5.

The sliding door latch 100 may be installed as a secondary safety latch on a sliding door 5 having a primary latch 7 located at an elevation within reach of the child 42. As illustrated, the sliding door latch 100 may be installed at an elevation X1 above the reach of the child 42, but readily within reach of an adult user 40, as shown.

As will be subsequently described in this disclosure, the installation of the sliding door latch 100 requires a minimal number of modifications to the sliding door 5, and the fixed door frame 13 surrounding the door. Installation may be performed by individuals having basic home maintenance skills and supplies.

The unique latching mechanism of the sliding door latch 100 advances the operational convenience of latching hardware by providing three user-selectable latch modes. A first "latched" mode prevents sliding door 5 from opening. A second "momentarily-released" mode allows the sliding door 5 to open, but immediately re-engages the latch when the door returns to the closed position. The third "held-in-release" mode maintains the sliding door latch 100 in an unlatch configuration until disengaged by the adult user 40. Thus, the adult user 40 can conveniently adjust the operation of the sliding door latch 100 in a manner best matching the operational and safety requirements of the sliding door 5.

Figure 2A:
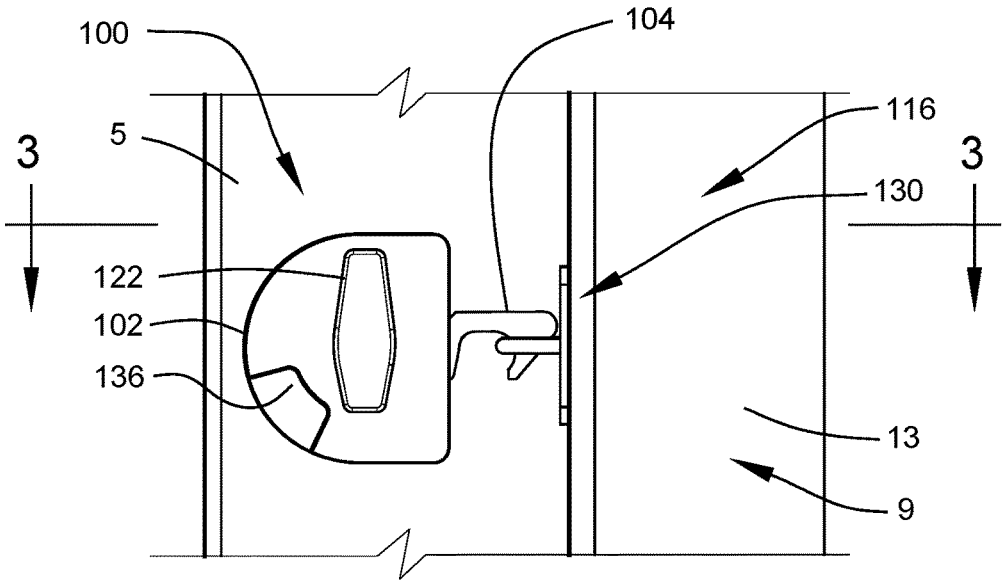
FIG. 2A is an elevational view of the sliding door latch of FIG. 1, arranged in a latched position, according to an embodiment of the present disclosure.
Figure 2B:
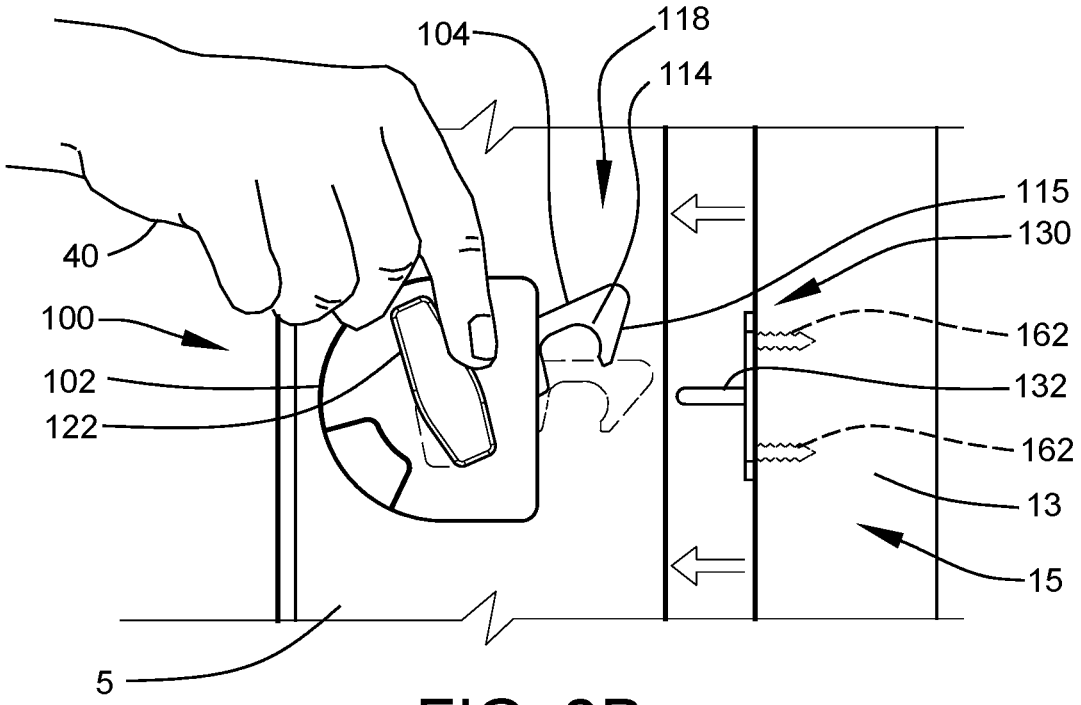
FIG. 2B is an elevational view of the sliding door latch of FIG. 1, arranged in a momentarily-released position, according to an embodiment of the present disclosure.
Figure 2C:
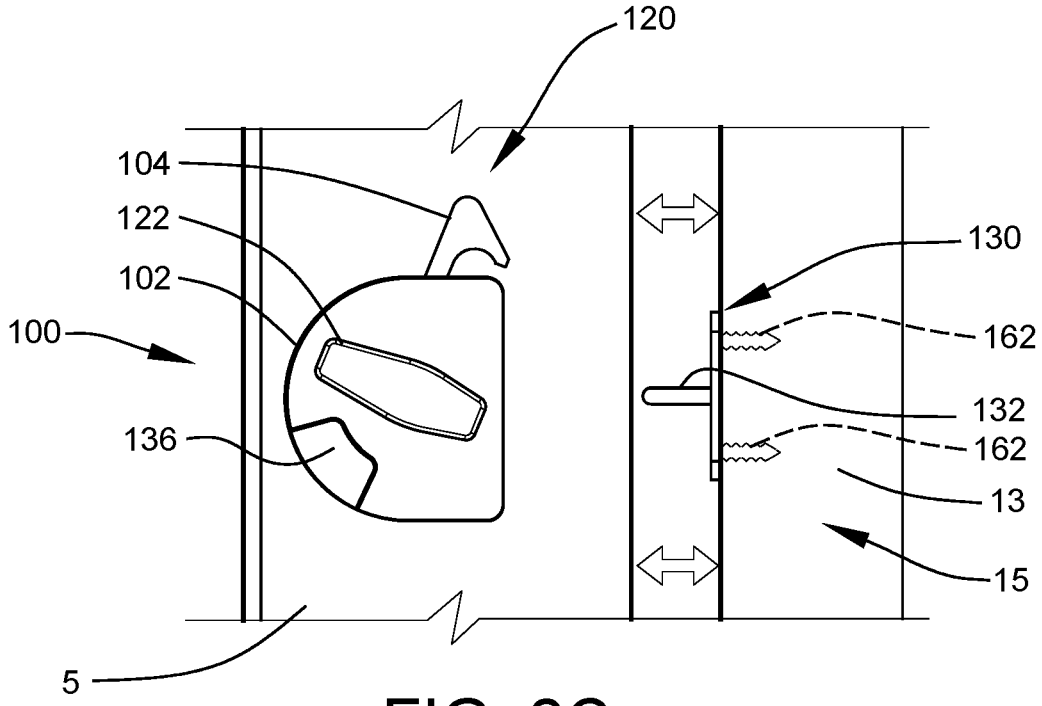
FIG. 2C is an elevational view of the sliding door latch of FIG. 1, arranged in a held-in-release position, according to an embodiment of the present disclosure.

FIG. 2A is an elevational view of the sliding door latch of FIG. 1, arranged in a latched position 116 used to secure the sliding door 5 in a closed position 9, according to an embodiment of the present disclosure. FIG. 2B is an elevational view of the sliding door latch of FIG. 1, arranged in a momentarily-released position 118 allowing the sliding door 5 to be moved an open position 15 and automatically re-latched when closed, according to an embodiment of the present disclosure. FIG. 2C is an elevational view of the sliding door latch 100 of FIG. 1, arranged in a held-in-release position 120, allowing the sliding door 5 to be moved between the open position 15 (as shown in FIG. 2C) and the closed position 9 without latching, according to an embodiment of the present disclosure.

Figure 3:
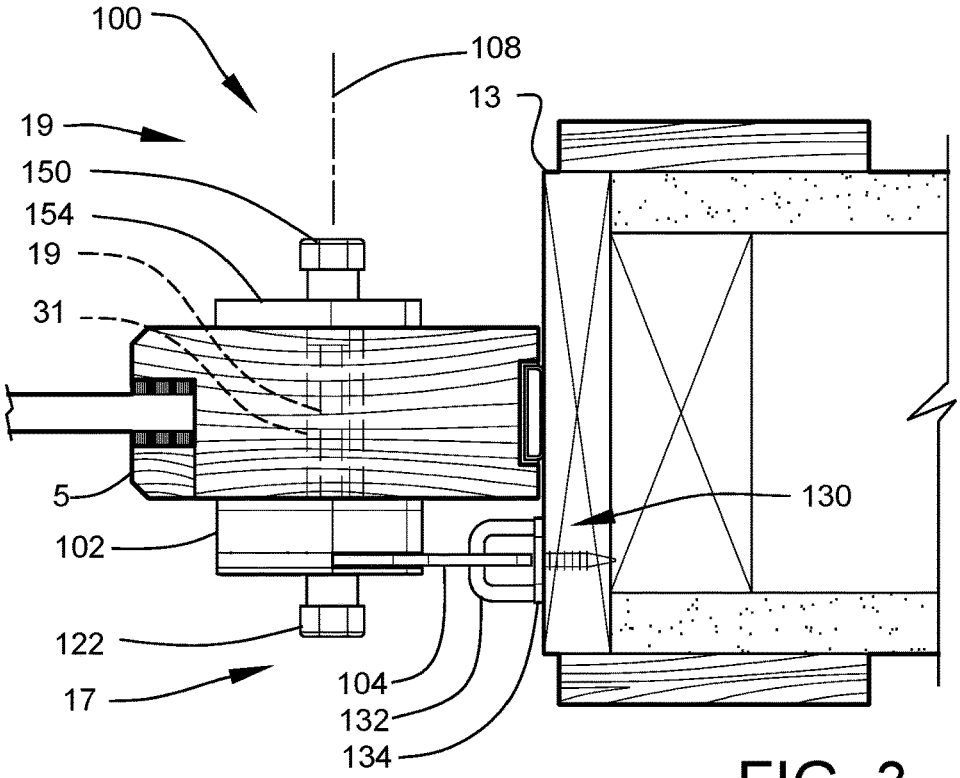
FIG. 3 is a view 3-3 of FIG. 2A, according to an embodiment of the present disclosure.
Figure 4:
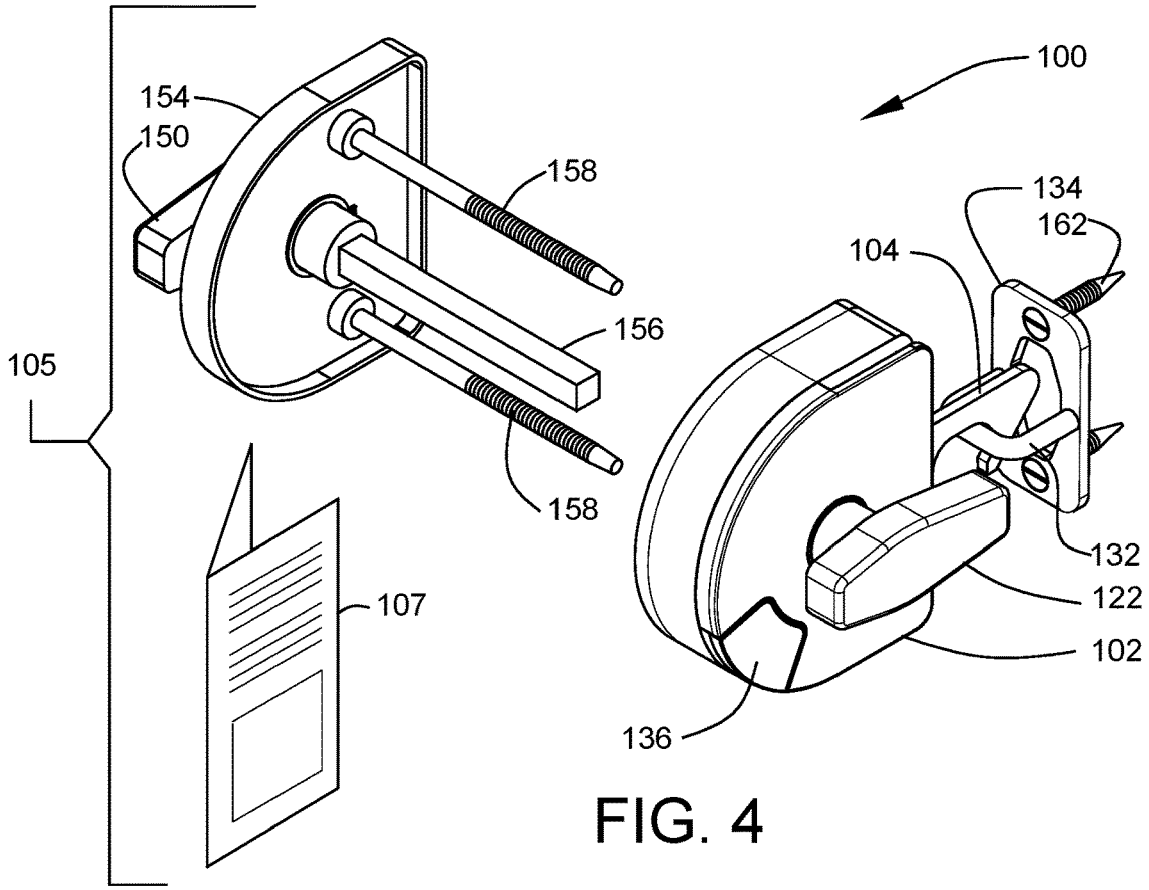
FIG. 4 is a perspective view of the sliding door latch of FIG. 1, according to an embodiment of the present disclosure.
Figure 5:
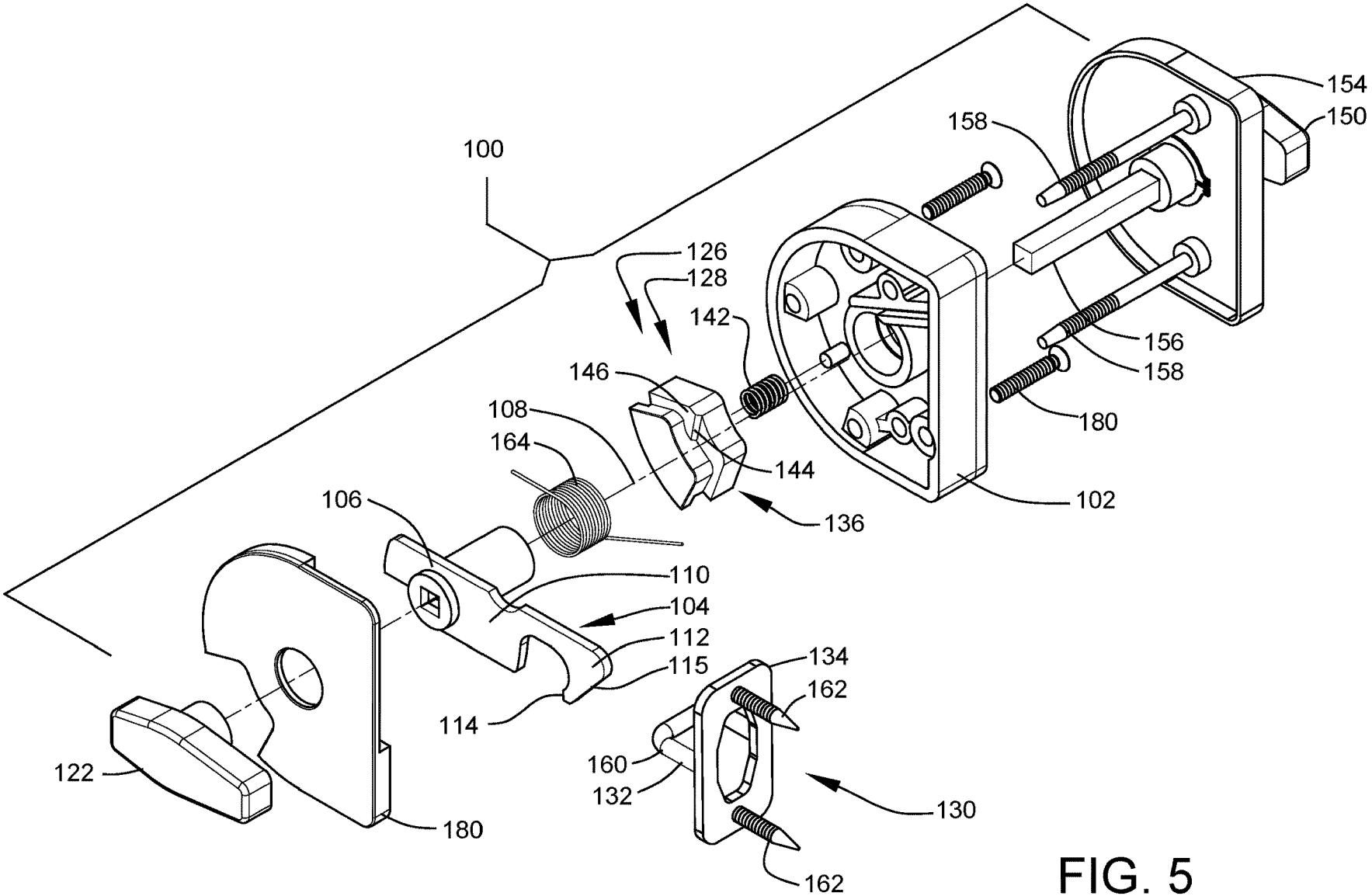
FIG. 5 is an exploded perspective view of the sliding door latch of FIG. 1, according to an embodiment of the present disclosure.

FIG. 3 is a sectional view 3-3 of FIG. 2A, according to an embodiment of the present disclosure. FIG. 4 is a perspective view of the sliding door latch 100 of FIG. 1, according to an embodiment of the present disclosure. FIG. 5 is an exploded perspective view of the sliding door latch 100 of FIG. 1, according to an embodiment of the present disclosure.

Referring to FIG. 1 through FIG. 5, the sliding door latch 100 may include a safety-latch housing 102 mountable to the sliding door 5, a latch arm 104 located outside the sliding door 5, and a catch member 130 mounted to the fixed door frame 13, as shown.

The latch arm 104 may include a proximal end 106, an intermediate portion 110, and a distal end 112, as shown. The proximal end 106 of the latch arm 104 may be pivotally mounted to an interior portion of a safety-latch housing 102 (see also FIG. 6) to enable rotation about a pivot axis 108. The intermediate portion 110 may extend from the proximal end 106 outwardly of the safety-latch housing 102, as shown. The distal end 112 may include a latch hook 114 adapted to engage the catch member 130 mounted to the fixed door frame 13. In this arrangement, the latch arm 104 and associated latch hook 114 may rotate about the pivot axis 108 between the latched position of FIG. 2A, the momentarily-released position 118 of FIG. 2B, and the held-in-release position 120 of FIG. 2C.

The sliding door latch 100 may further include a first actuator knob 122 (manual thumb turn) operationally coupled with the latch arm 104. A second actuator knob 150 may be provided, which may be similarly coupled with the latch arm 104. Both the first actuator knob 122 and the second actuator knob 150 may be configured to allow the user 40 to manually rotate the latch hook 114 about the pivot axis between the latched position 116, the momentarily-released position 118, and the held-in-release position 120. Depending on the configuration of the knobs, the user may simply push downwardly on one of the knobs to release the latch assembly. In the present disclosure, the first actuator knob 122 may be located on an interior side 17 of the sliding door 5 with the second actuator knob 150 located on an exterior side 19 of the sliding door 5, as best shown in FIG. 3.

The sliding door latch 100 may further include an outer housing plate 154 configured to support the second actuator knob 150 adjacent to the exterior side 19 of the sliding door 5. The door latch 100 may further include a spindle shaft 156 positioned coaxially with the pivot axis 108. The spindle shaft 156 may be configured to rotationally couple the first actuator knob 122, the latch arm 104, and the second actuator knob 150. A set of threaded fasteners 158 may be provided to join the outer housing plate 154 and the inner safety-latch housing 102. When the sliding door latch 100 installed, the sliding door 5 may be modified to provide one or more passages 31 through which the spindle shaft 156 and threaded fasteners 158 may extend.

A rotational biaser, such as a torsion spring 164 may rotationally bias the latch arm 104 and associated latch hook 114 toward the latched position 116. The torsion spring 164 may be configured to operably engage both the latch arm 104 and the safety-latch housing 102. In basic terms, the torsion spring 164 may act to continuously push the latch arm 104 and associated latch hook 114 toward the latched position 116.

Referring again to FIG. 3 and FIG. 4, the catch member 130 of the sliding door latch 100 may include a latch-hook receiver 132 combined with a frame mount 134, as shown. The latch-hook receiver 132 may be configured to receive the latch hook 114 in the latched position 116, as shown in FIG. 2A. In the present disclosure, the latch-hook receiver 132 is a U-shaped bar 160 projecting outwardly from the frame mount 134.

The frame mount 134 may be used to assist mounting of the latch-hook receiver 132 to the fixed door frame 13, as shown in FIG. 2A through FIG. 4. A set of threaded anchors 162 may be included to anchor the frame mount 134 to the fixed door frame 13. When mounted to the fixed door frame 13, the latch-hook receiver 132 functions to prevent translational movement of the latch arm 104 and the sliding movement of the sliding door 5 between the closed position 9 and the open position 15 when the latch hook 114 is in the latched position 116 of FIG. 2A. The U-shaped bar 160 and the latch hook 114 are generally aligned at the same elevation X1 relative to the sliding door 5, as shown.

The latch hook 114 may include an arm-pivoting strike 115 configured to pivot the latch arm 104 to a position allowing the latch hook 114 to pass over the U-shaped bar 160 during the sliding movement of the sliding door 5 between an open and the closed position 9.

The sliding door latch 100 may further include both a latch-arm retainer 126 and a latch-arm release 128. The latch-arm retainer 126 may be configured to releasably-retain the latch arm 104 in the held-in-release position 120 shown in FIG. 2C. The latch-arm release 128 may be configured to enable release of the latch arm 104 from the held-in-release position 120 of FIG. 2C to the latched position 116 of FIG. 2A.

Figure 6:
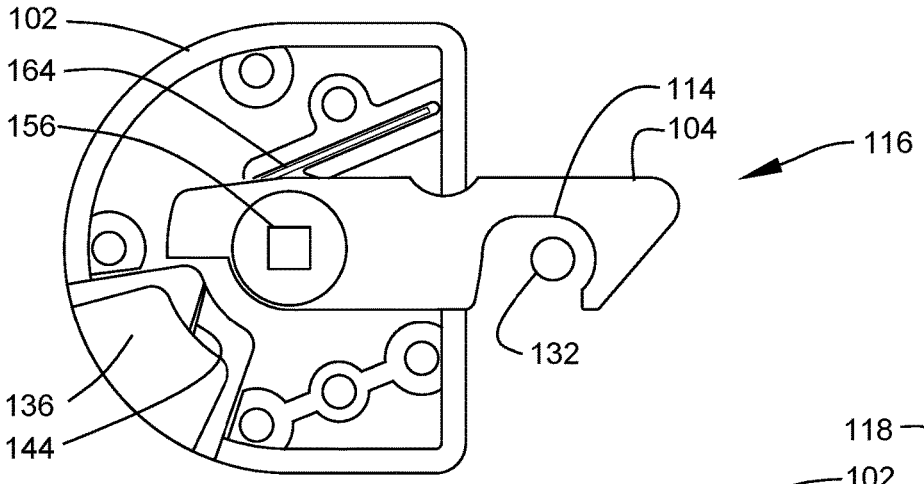
FIG. 6 is a diagrammatic view of the sliding door latch of FIG. 1, arranged in a latched position, according to an embodiment of the present disclosure.
Figure 7:
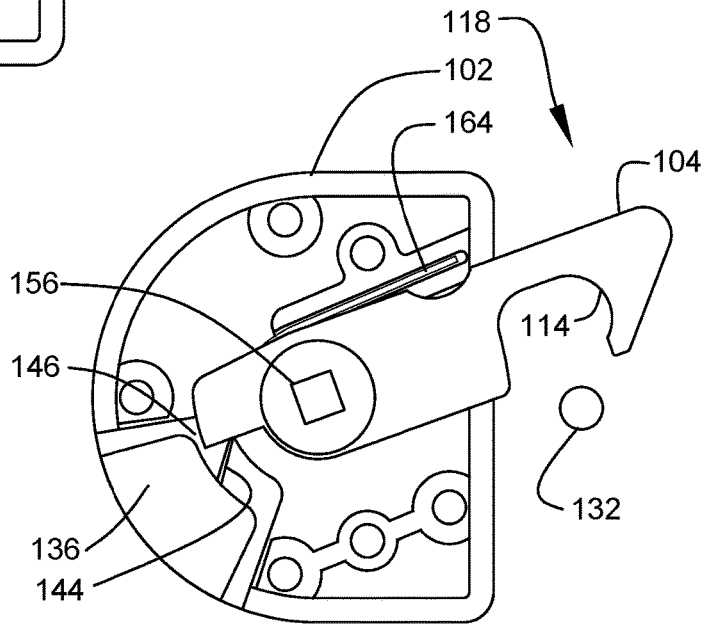
FIG. 7 is a diagrammatic view of the sliding door latch of FIG. 1, arranged in a momentarily-released position, according to an embodiment of the present disclosure.
Figure 8:
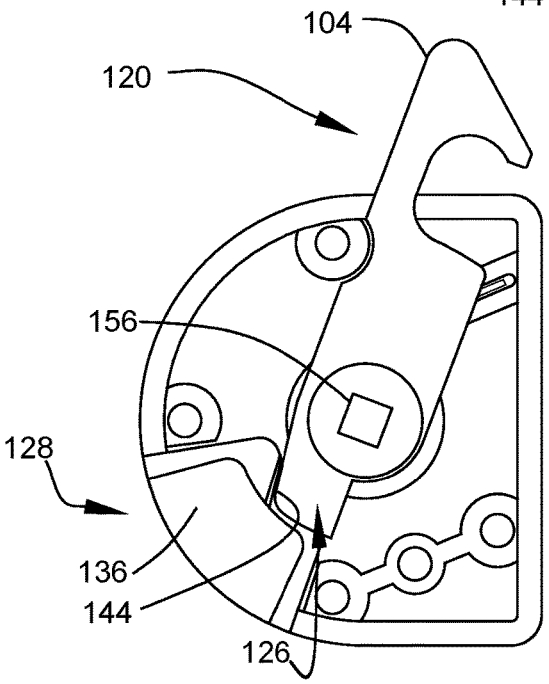
FIG. 8 is a diagrammatic view of the sliding door latch of FIG. 1, arranged in a held-in-release position, according to an embodiment of the present disclosure.
Figure 9:
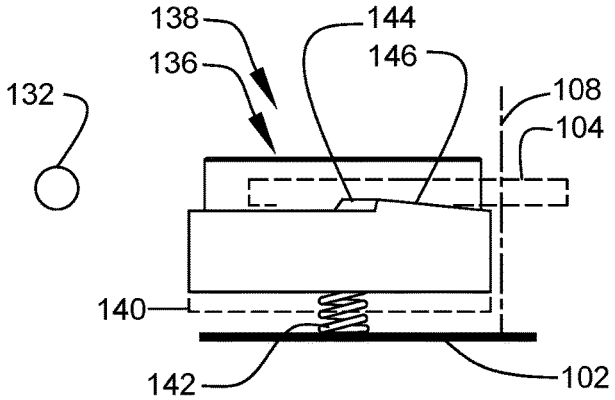
FIG. 9 is an elevational view of a button, according to an embodiment of the present disclosure.

FIG. 6 is a diagrammatic view of the sliding door latch 100 of FIG. 1, arranged in the latched position 116, according to an embodiment of the present disclosure. FIG. 7 is a diagrammatic view of the sliding door latch 100 of FIG. 1, arranged in the momentarily-released position 118, according to an embodiment of the present disclosure. FIG. 8 is a diagrammatic view of the sliding door latch of FIG. 1, arranged in a held-in-release position 120, according to an embodiment of the present disclosure. FIG. 9 is an elevational view of a button 136, according to an embodiment of the present disclosure.

In the present disclosure, the functions of the latch-arm release 128 and the latch-arm retainer 126 are enabled by the button 136 located on the interior side 17 of the sliding door 5, as shown. The button 136 may be configured to release the latch arm 104 from the held-in-release position 120 when the button 136 is moved from an initial position 138 to a depressed position 140 (see also the dashed-line depiction of FIG. 9). The button 136 may include an axial spring 142 (see FIG. 9) arranged to bias the button 136 toward the initial position 138.

The latch-arm retainer 126 may be implemented by a latch-arm retaining wall 144 formed within the button 136. The step-shaped latch-arm retaining wall 144 may be arranged to retain the latch arm 104 in the held-in-release position 120 when the button 136 is located in the initial position 138. Moreover, the latch-arm retaining wall 144 may be configured to release the latch arm 104 from the held-in-release position 120 when the button 136 is moved to the depressed position 140.

The button 136 may include a guide surface 146 adapted to guide the latch arm 104 to a position of retained engagement with the latch-arm retaining wall 144 as the latch arm 104 is rotated from the latched position 116 to the held-in-release position 120. In the depicted embodiment of the present disclosure, the guide surface 146 takes the form of a ramped plane oriented non-orthogonally to the pivot axis 108, as shown in FIG. 9. The guide surface 146 may be configured move the button 136 toward the depressed position 140 as the latch arm 104 is rotated from the latched position 116 of FIG. 6 toward the held-in-release position 120 of FIG. 8. The axial spring 142 is arranged to bias the button 136 toward the initial position 138 when the latch arm 104 interacts to form such retained engagement with the latch-arm retaining wall 144 at the held-in-release position 120. The spring force applied on the button 136 by the axial spring 142 functions to hold the latch-arm retaining wall 144 of the button in a position preventing the latch arm 104 from returning to the latched position 116. Pressing the button 136 has the effect of moving the latch-arm retaining wall 144 away from latch arm 104, thus allowing the latch arm 104 to pivot back to the latched position 116. Further, the latch arm 104 remains in the momentarily released position 118 until the latch arm is fully turned to the point of engagement with the latch-arm retaining wall 144. the functions of the guide surface 146 may be integrated within other structures of the apparatus, for example, a guide surface may be formed within the latch arm, etc.

The sliding door latch 100 may include other miscellaneous assembly components 180, as required by the door application. Such miscellaneous assembly components 180 may include, for example, fasteners, access plates, retainers, gaskets, etc. Those with ordinary skill in the art will now appreciate that, upon reading this specification combined with their knowledge of the art of door hardware, methods of arranging hardware assemblies.

As above, installation of the sliding door latch 100 requires minimal modifications to sliding door 5 and fixed door frame 13 surrounding the door. The unique external latch-arm position eliminates the need to perform difficult morticing of an existing required by conventional latches. Installation may be performed by individuals having basic home maintenance tools. Modifying the sliding door to provide a passage through which the spindle shaft 156 and threaded fasteners 158 may be accomplished using, for example, a hand drill. Installation of the remaining components may be accomplished using a screwdriver, drill driver, or similar device. Under appropriate circumstances, considering such issues as user preferences, design preference, structural requirements, marketing preferences, cost, available materials, technological advances, etc., other installation arrangements such as, for example, preparing a sliding door to receive a sliding door latch system at the factory, etc., may be sufficient.

Alternate embodiments of the present disclosure may include both the sliding door latch system and the sliding door 5. In this alternate arrangement, a sliding door latch system may be included with the sliding door and frame at the factory during fabrication. In one arrangement, the sliding door may include a primary latch 7 with the sliding door latch system located at an elevation above the primary latch 7, as generally illustrated in FIG. 1.

The sliding door latch 100 may be constructed from one or more durable materials. Materials suitable for use in the construction of the sliding door latch system may include rigid plastic, aluminum, and stainless steel. The selected materials may be finished in a wide range of colors and surface finishes.

According to one embodiment of the present disclosure, the sliding door latch 100 may be arranged as a kit 105. In particular, the sliding door latch 100 and associated components may further include a set of instructions 107. The instructions 107 may detail functional relationships about the structure of the sliding door latch 100 such that the sliding door latch 100 can be installed, used, maintained, or the like, in a preferred manner. The instructions 107 may include one or templates useable to facilitate installation.

Figure 10:
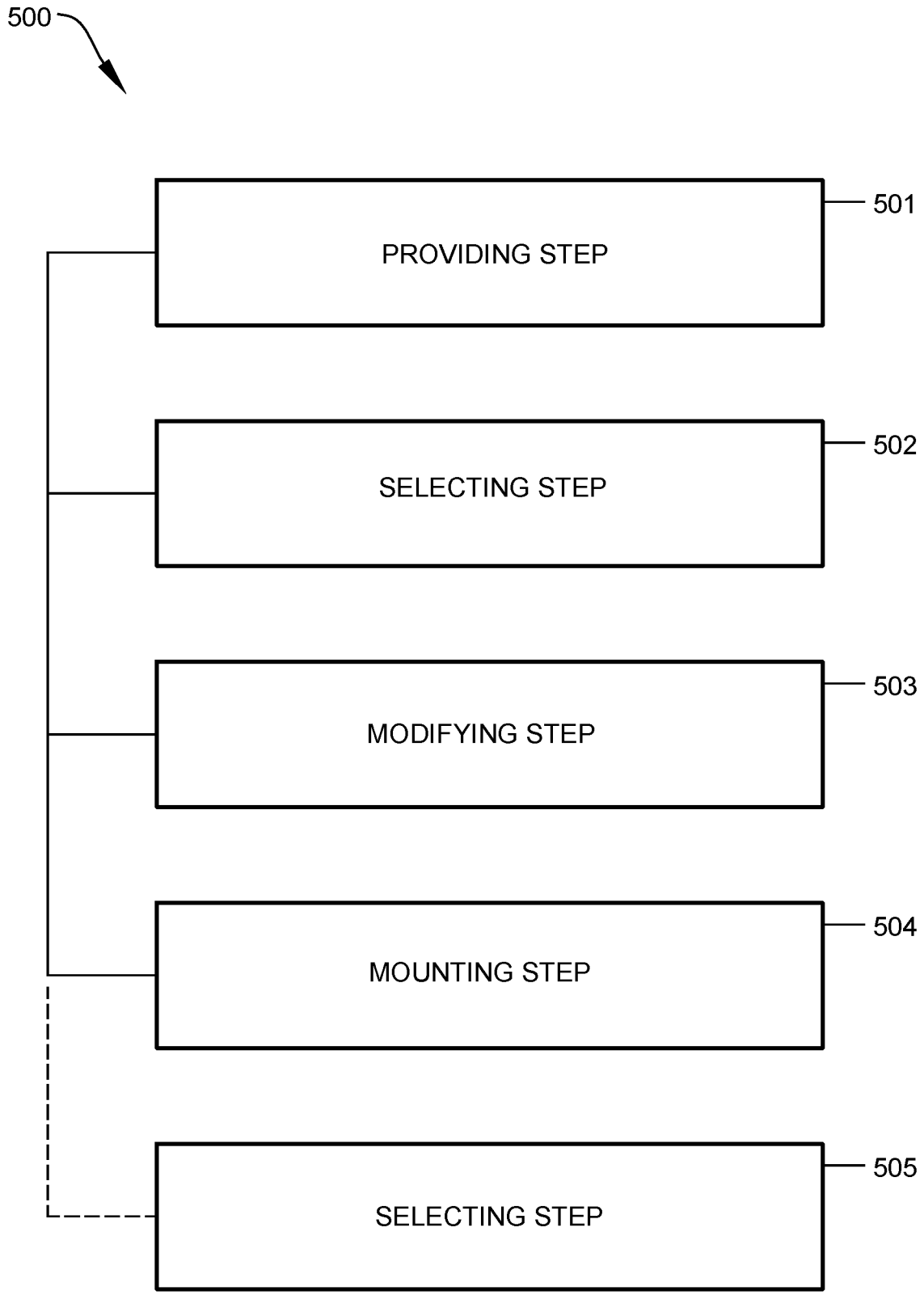
FIG. 10 is a flow diagram illustrating a method of the sliding door latch, according to an embodiment of the present disclosure.

FIG. 10 is a flow diagram illustrating a method 500 for using a sliding door latch 100 of a sliding door latch system to selectively prevent sliding movement of a sliding door having a primary latch, between a closed position and an open position relative to a fixed door frame, according to an embodiment of the present disclosure. In particular, the method 500 may include one or more components or features of the sliding door latch 100, as described above. As illustrated, the method 500 may include the steps of: step one 501, providing a sliding door latch system having a latch arm located outside the sliding door and user-locatable in a latched position, a momentarily released position, and a held-in-release position; a first actuator knob and a second actuator knob operationally coupled with the latch arm and configured to enable rotation of the latch hook between the latched position, the momentarily-released position, and the held-in-release position, a spindle shaft configured to rotationally couple the first actuator knob, the latch arm, and the second actuator knob, and a fixed catch member mountable to the fixed door frame, the fixed catch member configured to receive the latch arm in the latched position; step two 502, selecting a mounting position for mounting the sliding door latch system to the sliding door; step three 503, modifying the sliding door to provide a passage through which the spindle shaft may pass; step four 504, mounting the sliding door latch system to the sliding door including mounting the fixed catch member to the fixed door frame; whereby the sliding movement of the sliding door between the closed position and the open position relative to the fixed door frame is selectively prevented.

Even further, it provides such a method 500, further comprising the step five 505 of selecting a mounting position for mounting the sliding door latch system to the sliding door having an elevation above the primary latch.

It should be noted that step 505 is optional and may not be implemented in all cases. Optional steps of method 500 are illustrated using dotted lines in FIG. 10 to distinguish them from the other steps of method 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for are taught herein.

The embodiments of the invention described herein are exemplary, and numerous modifications, variations, and rearrangements can be readily envisioned to achieve substantially equivalent results, all of which are intended to be embraced within the spirit and scope of the invention. Further, the purpose of the abstract is to enable the U.S. Patent and Trademark Office, the public, scientists, engineers, and practitioners in the art who are not familiar with patent or legal terms to determine quickly from a cursory inspection the nature and essence of the technical disclosure of the application.

What is claimed is:

1. A sliding door latch system comprising:

a safety-latch housing;

a latch arm located outside the sliding door, the latch arm including a first end pivotally connected to an interior of the housing and configured to rotate about a pivot axis, an intermediate portion extending out from the first end, and a second end including a latch hook that rotates with the latch arm about the pivot axis between a latched position, a momentarily-released position, and a held-in-release position, a first actuator knob operationally coupled with the latch arm, the first actuator knob configured to enable rotation of the hook about the pivot axis between the latched position, the momentarily-released position, and the held-in-release position;

a rotational biaser coupled to the latch arm and configured to rotationally bias the hook toward the latched position;

a latch-arm retainer configured to retain the latch arm in the held-in-release position, wherein the latch-arm retainer comprises a latch-arm retaining wall formed within a button, the retaining wall retains the latch arm in the held-in-release position when the button is in an initial position and the wall releases the latch arm from the held-in-release position when the button is depressed;

a latch-arm release configured to enable release of the latch arm from the held-in-release position to the latched position, wherein the latch-arm release comprises the button movable from the initial position to a depressed position that releases the latch arm the latch arm when the button is moved to the depressed position, wherein the button comprises an axial spring configured to bias the button toward the initial position and the button comprises a guide surface configured to guide the latch arm to a retained engagement position with the wall as the latch arm is rotated from the latched position to the held-in-release position; and a fixed catch member including a latch-hook receiver configured to receive the hook in the latched position, wherein the latch-hook receiver prevents translational movement of the latch arm and sliding movement of the door between a closed position and an open position, and a frame mount configured for mounting the latch-hook receiver to a fixed door frame, wherein the guide surface comprises a ramped plane oriented non-orthogonally to the pivot axis, the ramped plane moves the button toward the depressed position when the latch arm rotates from the latched position toward the held-in-release position; and the button moves toward the initial position when the latch arm engages with the wall at the held-in-release position.

2. The system of claim 1, further comprising a second actuator knob operationally coupled to the latch arm, and wherein the second actuator knob enables rotation of the hook about the pivot axis between the latched position, the momentarily-released position, and the held-in-release position;

wherein the first actuator knob is located on an interior side of the door; and wherein the second actuator knob is located on an exterior side of the door.

3. The system of claim 2, further comprising an outer housing plate configured to support the second actuator knob adjacent the exterior side.

4. The system of claim 3, further comprising a spindle shaft positioned coaxially with the pivot axis, the spindle shaft rotationally coupling the first actuator knob, the latch arm, and the second actuator knob.

5. The system of claim 3, further comprising threaded fasteners joining the outer housing plate and the through the door.

6. The system of claim 1, wherein the latch-hook receiver comprises a U-shaped bar projecting out from the frame mount;

the bar and the hook are aligned at the same height relative to the door; and the hook comprises an arm-pivoting strike configured to pivot the the latch arm to a position allowing the hook to pass over the bar during sliding movement of the door between an open and closed position.

7. The system of claim 1, further comprising threaded anchors configured to anchor the frame mount to the fixed door frame.

8. The system of claim 1, wherein the system is constructed from a material comprising any one or any combination of plastic, aluminum, or stainless steel.

9. The system of claim 1, wherein the rotational biaser comprises a torsion spring configured to engage the latch arm and the housing.

10. The system of claim 1, wherein the release is located on an interior side of the door.

11. A sliding door latch system for selectively preventing sliding movement of a sliding door having a primary latch the system comprising:

a safety-latch housing;

a latch arm located outside the door and including a first end pivotally connected to an interior of the housing and configured to rotate about a pivot axis, an intermediate portion extending out from the first end, and a second end including a latch hook that rotates with the latch arm about the pivot axis between a latched position, a momentarily-released position, and a held-in-release position;

a first actuator knob coupled with the latch arm, the first actuator knob configured to enable rotation of the hook about the pivot axis between the latched position, the momentarily-released position, and the held-in-release position;

a second actuator knob coupled with the latch arm and configured to enable rotation of the hook about the pivot axis between the latched position, the momentarily-released position, and the held-in-release position;

a rotational biaser coupled to the latch arm and configured to rotationally bias the hook toward the latched position;

a latch-arm retainer configured to releasably-retain the latch arm in the held-in-release position;

a latch-arm release configured to enable release of the latch arm from the held-in-release position to the latched position; and a fixed catch member including a latch-hook receiver configured to receive the hook in the latched position, wherein the receiver prevents translational movement of the latch arm and sliding movement of the door when the hook is in the latched position, and a frame mount configured to assist mounting of the receiver to a fixed door frame;

an outer housing plate configured to support the second actuator knob adjacent an exterior side of the door;

a spindle shaft positioned coaxially with the pivot axis, the spindle shaft configured to rotationally couple the first actuator knob, the latch arm, and the second actuator knob;

threaded fasteners extending through the door connected to the outer housing plate and the safety-latch housing;

threaded anchors configured to anchor the frame mount to the fixed door frame; and the door including the primary latch, wherein the first actuator knob is located on an interior side of the door;

wherein the second actuator knob is located on an exterior side;

wherein the release comprises a button movable between an initial position and a depressed position;

wherein the button is configured to release the latch arm from the held-in-release position when the button is moved to the depressed position;

wherein the button comprises an axial spring configured to bias the button toward the initial position;

wherein the retainer comprises a latch-arm retaining wall formed within the button, the wall configured to retain the latch arm in the held-in-release position when the button is located in the initial position;

wherein the wall is configured to release the latch arm from the held-in-release position when the button is moved to the depressed position;

wherein the button comprises a guide surface configured to guide the latch arm to a position of retained engagement with the wall as the latch arm rotates from the latched position to the held-in-release position;

wherein the guide surface comprises a ramped plane oriented non-orthogonally to the pivot axis, the ramped plane configured move the button toward the depressed position as the latch arm rotates from the latched position toward the held-in-release position;

wherein the button is configured to move toward the initial position when the latch arm interacts to form such retained engagement with the wall at the held-in-release position;

wherein the latch-hook receiver comprises a U-shaped bar projecting outwardly from the frame mount;

wherein the U-shaped bar and the latch hook and are aligned at a common elevation relative to the sliding door;

wherein the latch hook comprises an arm-pivoting strike configured to pivot the latch arm to a position allowing the latch hook to pass over the U-shaped bar during sliding movement of the door between an open and the closed position;

wherein the system is constructed from a material comprising any one or any combination rigid plastic, aluminum, and stainless steel;

wherein the rotational biaser comprises a torsion spring configured to engage the latch arm and the safety-latch housing;

wherein the latch-arm release is located on the interior side; and wherein the system is located above the primary latch.

12. The system of claim 11, further comprising a set of instructions; and wherein the system is arranged as a kit.

13. A method of using a sliding door latch system on a sliding door (including a primary latch) comprising the step of preventing sliding movement of the door between a closed and an open position comprising:

providing a sliding door latch system comprising a safety-latch housing;

a latch arm located outside the sliding door, the latch arm including a first end pivotally connected to an interior of the housing and configured to rotate about a pivot axis, an intermediate portion extending out from the first end, and a second end including a latch hook that rotates with the latch arm about the pivot axis between a latched position, a momentarily-released position, and a held-in-release position, a first actuator knob operationally coupled with the latch arm, the first actuator knob configured to enable rotation of the hook about the pivot axis between the latched position, the momentarily-released position, and the held-in-release position;

a rotational biaser coupled to the latch arm and configured to rotationally bias the hook toward the latched position;

a latch-arm retainer configured to retain the latch arm in the held-in-release position, wherein the latch-arm retainer comprises a latch-arm retaining wall formed within a button, the retaining wall retains the latch arm in the held-in-release position when the button is in an initial position and the wall releases the latch arm from the held-in-release position when the button is depressed;

a latch-arm release configured to enable release of the latch arm from the held-in-release position to the latched position, wherein the latch-arm release comprises the button movable from the initial position to a depressed position that releases the latch arm when the button is moved to the depressed position, wherein the button comprises an axial spring configured to bias the button toward the initial position and the button comprises a guide surface configured to guide the latch arm to a retained engagement position with the wall as the latch arm is rotated from the latched position to the held-in-release position; and a fixed catch member including a latch-hook receiver configured to receive the hook in the latched position, wherein the latch-hook receiver prevents translational movement of the latch arm and sliding movement of the door between a closed position and an open position, and a frame mount configured for mounting the latch-hook receiver to a fixed door frame, wherein the guide surface comprises a ramped plane oriented non-orthogonally to the pivot axis, the ramped plane moves the button toward the depressed position when the latch arm rotates from the latched position toward the held-in-release position; and the button moves toward the initial position when the latch arm engages with the wall at the held-in-release position;

selecting a mounting position for mounting the system to the door;

modifying the door to provide a passage for the spindle shaft; and mounting the system to the door including mounting the fixed catch member to a fixed door frame.

14. The method of claim 13, wherein the selecting step comprises selecting a position above the primary latch.

* * * * *